United States Patent [19]

Goad

[11] 4,051,894

[45] Oct. 4, 1977

[54] SINGLE STRING HANGER SYSTEM

[75] Inventor: Bobby F. Goad, Spring, Tex.

[73] Assignee: Baker International Corporation, Orange, Calif.

[21] Appl. No.: 704,125

[22] Filed: July 12, 1976

[51] Int. Cl.[2] ..... E21B 7/12

[52] U.S. Cl. ..... 166/73; 166/334

[58] Field of Search ..... 166/70, .5, .6, 73, 166/85, 124, 315; 285/137 A

[56] References Cited

U.S. PATENT DOCUMENTS

| | | | |
|---|---|---|---|
| 3,154,145 | 10/1964 | Brown | 166/73 |
| 3,494,417 | 2/1970 | Fredd | 166/73 |
| 3,653,435 | 4/1972 | Reistle et al. | 166/313 |
| 3,770,053 | 11/1973 | Martin et al. | 166/.5 |
| 3,861,463 | 1/1975 | Crowe | 166/.5 |
| 3,955,621 | 5/1976 | Webb | 166/.5 |

*Primary Examiner*—James A. Leppink

[57] ABSTRACT

Apparatus for adjusting the distance between a lower tubing hanger anchored in a well casing to support a depending lower tubing string, and an upper tubing hanger at the well head, in which an adjustable spacer device has its lower end connected to the lower tubing hanger and its upper end to the lower end of a safety valve connected to an upper tubing string extending to the upper tubing anchor, the valve being controlled hydraulically by fluid under pressure imparted through a control line strapped, or otherwise secured, to the upper tubing string and extending from the top of the well to the safety valve. The upper tubing string, safety valve and control line, as well as the upper portion of the spacer, are rotatable as a unit with respect to the lower portion of the spacer to lower the unit relative to the lower tubing hanger until the upper tubing hanger lands on its well head seat, such action occurring without twisting the control tubing relative to the safety valve.

7 Claims, 7 Drawing Figures

SINGLE STRING HANGER SYSTEM

Figure 1A:
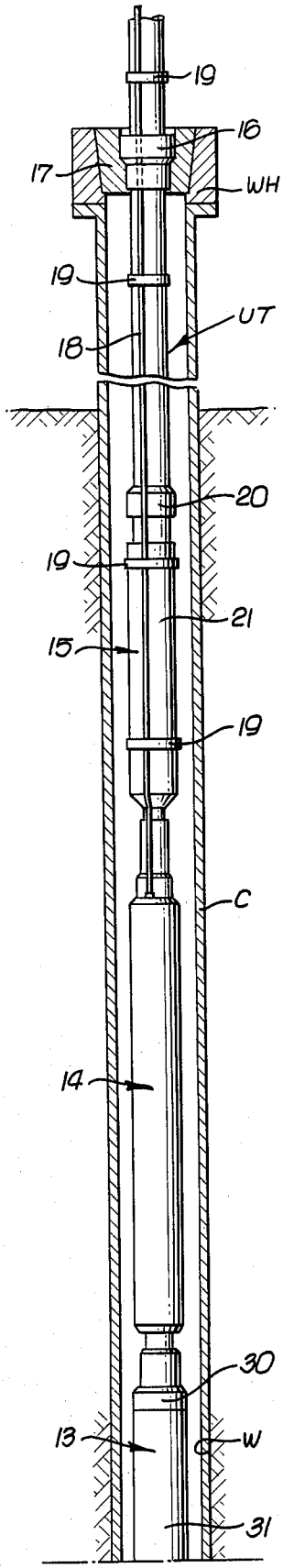

The present invention relates to oil and/or gas well production apparatus, and more particularly to apparatus in which the well production flows through a subsurface safety valve, and tubing connected thereto, the valve being held open by fluid pressure applied from a source at the top of the well through a control line extending along the tubing to the safety valve.

Safety valves have been installed in tubing disposed in well bores, which are controlled by a source of pressure at the surface or top of the well to normally maintain the safety valve open. The pressure is conducted to the safety valve through a relatively small control line secured to the tubing, such as by strapping, in order to support the control line and hold it against the string of tubing extending upwardly from the safety valve. The safety valve and upper tubing are supported from a subsurface tubing hanger suitably secured or mounted in the well casing, the top end of the tubing string being fixed to a surface tubing hanger. To secure the proper relation or spacing between the lower tubing hanger and the upper surface tubing hanger, a spacer device, such as shown in U.S. Pat. No. 3,861,463, FIG. 3*d*, is installed in the apparatus located within the well casing below its surface. Such spacer device can be of the rotational and threaded type, which enables the apparatus to be landed in the lower tubing hanger, with the upper tubing string then rotated to thread the upper portion of the spacer downwardly relative to the lower portion, in order to bring the surface tubing hanger into engagement with a seat at the well head, thereby appropriately spacing the apparatus between the lower tubing hanger and the surface tubing hanger.

In prior arrangements, and particularly where a single string of tubing is used in the well casing, difficulties have been encountered with the rotational spacer. During rotation of the upper tubing string to thread one portion of the spacer downwardly relative to another portion of the spacer, the tubing string has been rotated relative to the safety valve, which produces relative rotation between the safety valve and the upper surface tubing string, the control line being wrapped around the upper tubing string as well as being compressed, which could result in damage to the control line and its disruption.

By virtue of the present invention, a rotational spacer is installed in the apparatus at a location which permits the upper tubing string, safety valve and the control line to be rotated as a unit, for the purpose of threading or feeding the upper portion of the rotational spacer longitudinally with respect to the lower portion of the rotational spacer, and the lower tubing hanger associated therewith, thereby bringing the surface tubing hanger into appropriate seating engagement with the well head. More specifically, the rotational spacer is installed between the safety valve and the lower tubing hanger, which enables the upper tubing string to be secured directly or indirectly to the safety valve, with the surface control line or control tubing fixed at its lower end to the safety valve and secured at spaced points, as by straps, to the tubing string extending to the top of the well. Accordingly, rotation of the tubing string, safety valve and surface control line occurs as an integral unit, as set forth above, so that there is no wrapping of the control line around the tubing string as the latter rotate for the purpose of effecting the appropriate space relation between the upper tubing hanger and the lower tubing hanger.

This invention possesses many other advantages, and has other objects which may be made more clearly apparent from a consideration of a form in which it may be embodied. This form is shown in the drawings accompanying and forming part of the present specification. It will not be described in detail, for the purpose of illustrating the general principles of the invention; but it is to be understood that such detailed description is not to be taken in a limiting sense.

Figure 1B:
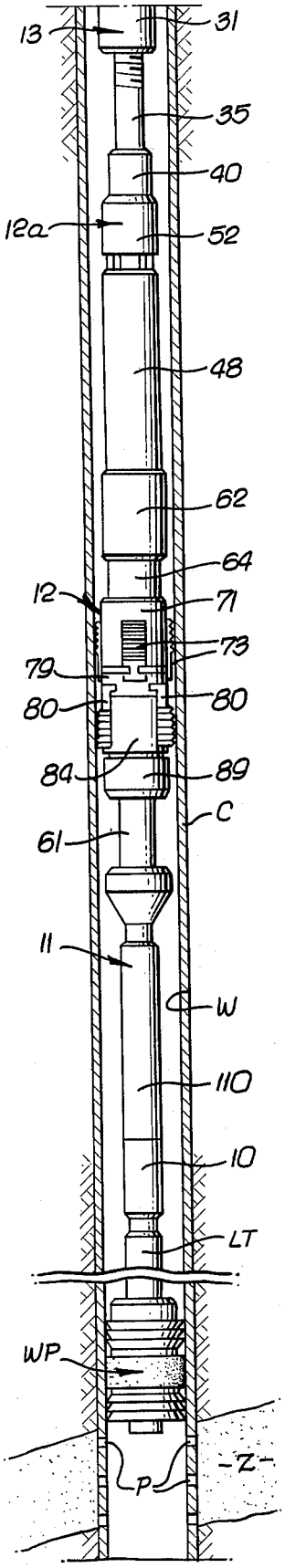

Referring to the drawings:

FIGS. 1*a* and 1*b* together illustrate somewhat diagrammatically an apparatus embodying the invention installed in a well bore, FIG. 1*b* being a lower continuation of FIG. 1*a*.

FIGS. 2*a*, 2*b*, 2*c*, 2*d*, and 2*e* together constitute a combined side elevational and longitudinal sectional view of the major portion of the apparatus disclosed in FIGS. 1*a* and 1*b*, FIGS. 2*b*, 2*c*, 2*d*, and 2*e* being longitudinal continuations of FIGS. 2*a*, 2*b*, 2*c*, and 2*d*, respectively.

As illustrated in the drawings, a well bore W has casing C installed in it, the casing passing through a producing zone Z, production from said zone being able to pass through casing perforations P into the interior of the casing. A suitable well packer WP is anchored in packed-off condition in the casing above the perforations P, a lower tubing string LT being appropriately connected to, or otherwise associated with, the packer, so that the well production can flow through the lower tubing string LT toward the top of the well, as described hereinbelow. The upper end of the lower tubing string is connected to the bottom sub 10 of a device 11 for enabling pressure to be developed in the tubing thereabove as described below, the sub being connected, directly or indirectly, to a single string tubing hanger 12 adapted to be anchored against the wall of the well casing C, or otherwise supported therein.

A rotational spacer 13 is secured to the upper portion of the tubing hanger 12 through an intervening seal assembly 12*a*, this rotational spacer being attached to the lower end of a tubing mounted safety valve 14 which, in turn, is secured to a shear out safety joint 15. This joint has its upper end connected to an upper tubing string UT extending to the top of the well and attached to a suitable upper tubing hanger 16 adapted to seat in a bushing 17, which, in turn, seats in the well head WH fixed to the upper end of the string of casing C. A surface control line 18 has its lower end suitably connected to the safety valve 14, this control line extending upwardly along the safety joint 15 and the upper tubing string UT to the surface, where its upper end is connected to a suitable source of hydraulic pressure (not shown) to enable the safety valve to be held in an open position when the fluid in the control line is under pressure. Relieving of the control line pressure enables the safety valve to close automatically, as is well known. The surface control line 18 is secured to the shear out safety joint 15 and to the upper tubing string UT by means of a plurality of straps 19.

Figure 2A:
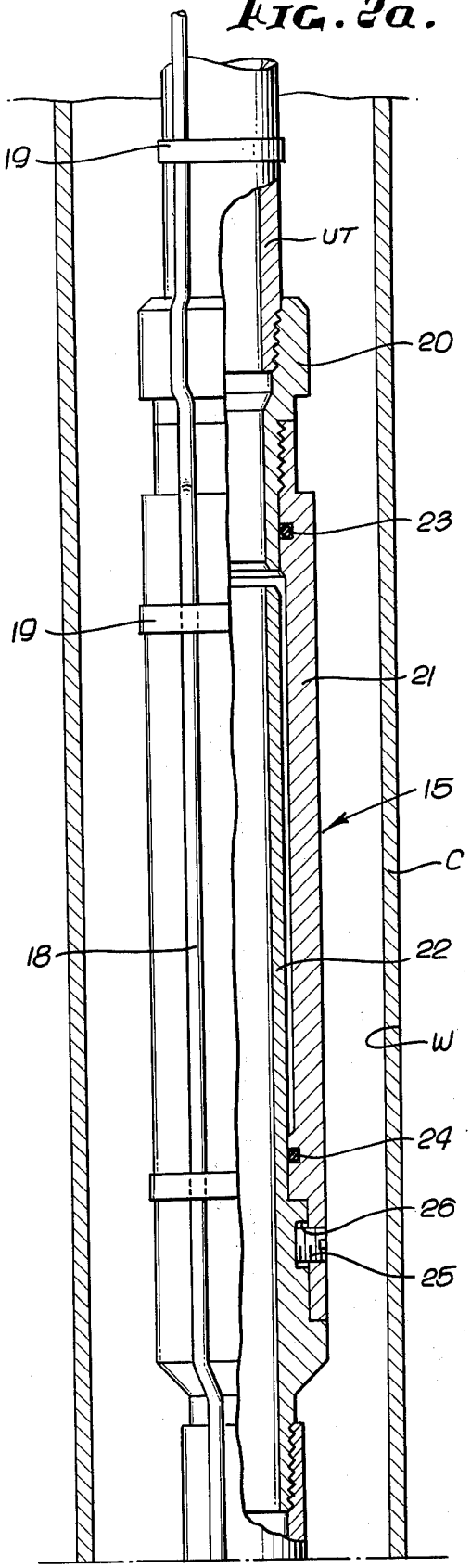

As disclosed in FIG. 2*a*, the shear out safety joint 15 includes a top sub 20 threadedly secured to the lower end of an adjacent section of the upper tubing UT, this top sub being threadedly secured to the upper end of an elongate housing 21 encompassing a mandrel 22, the lower end of which is secured, directly or indirectly, to the tubing mounted safety valve 14. The housing 21 has an upper seal ring 23 sealing against the top sub 20 to prevent leakage through the threaded connection between the sub and housing, and also has a lower seal ring 24 slidably and sealingly engaging the periphery of the mandrel 22. A plurality of shear screws 25 are threaded through the lower portion of the housing 21, each of the screws being disposed in a socket 26 in the lower portion of the mandrel, so that the housing 21 and mandrel 22 move longitudinally together, and are also coupled together for joint rotation. If sufficient upward pull is taken on the housing 21 exceeding the shear strength of the screws, the latter are disrupted, allowing the housing 21 to move upwardly along the mandrel 22 and the upper tubing string UT and housing to be removed from the well casing C, leaving the remainder of the apparatus below the housing in the well bore.

The shear out safety joint 15 forms no part of the present invention and may be omitted from the assembly, in which event the tubing string UT is connected directly to the safety valve 14. However, if used, its lower end is connected to the upper end of the tubing mounted safety valve, which may be of any suitable construction, for example, of the specific types illustrated in U.S. Pat. No. 3,868,995, which contain a ball valve member 28, illustrated in FIG. 2*b* as being in open condition. The member 28 is rotatable into a position closing the passage 29 through the tubing mounted safety valve, in a known manner. The lower end of the surface control line 18 is illustrated as being secured to the upper portion of the tubing mounted safety valve, the pressure in the control line 18 being adapted to act upon a suitable pressure responsive surface to shift the ball valve member 28 to its open position.

Figure 2B:
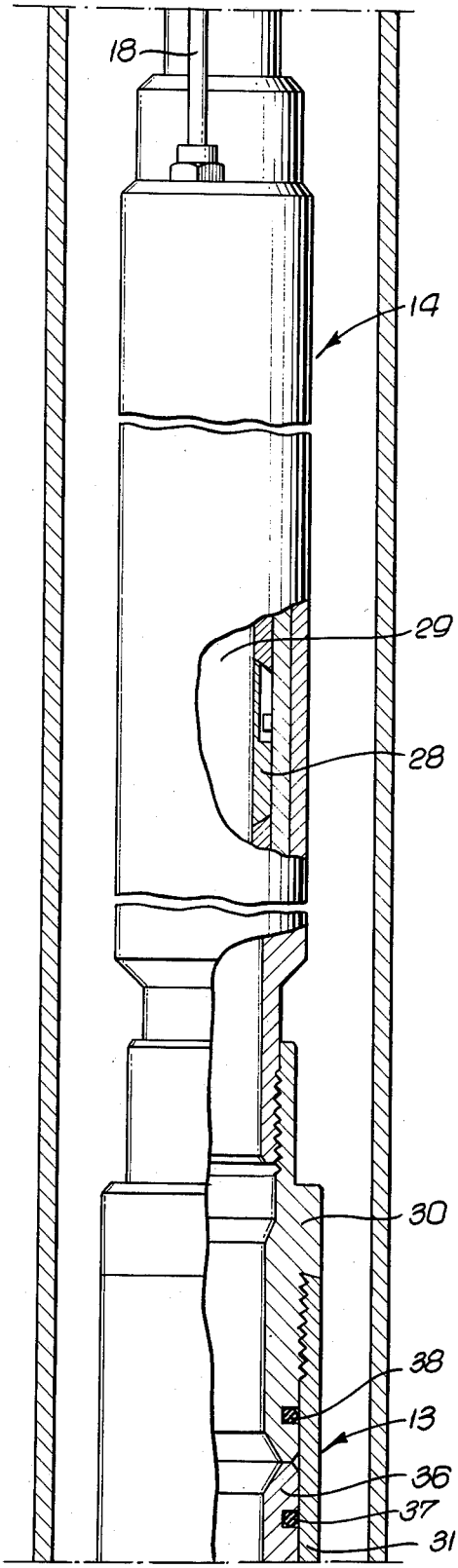
Figure 2C:
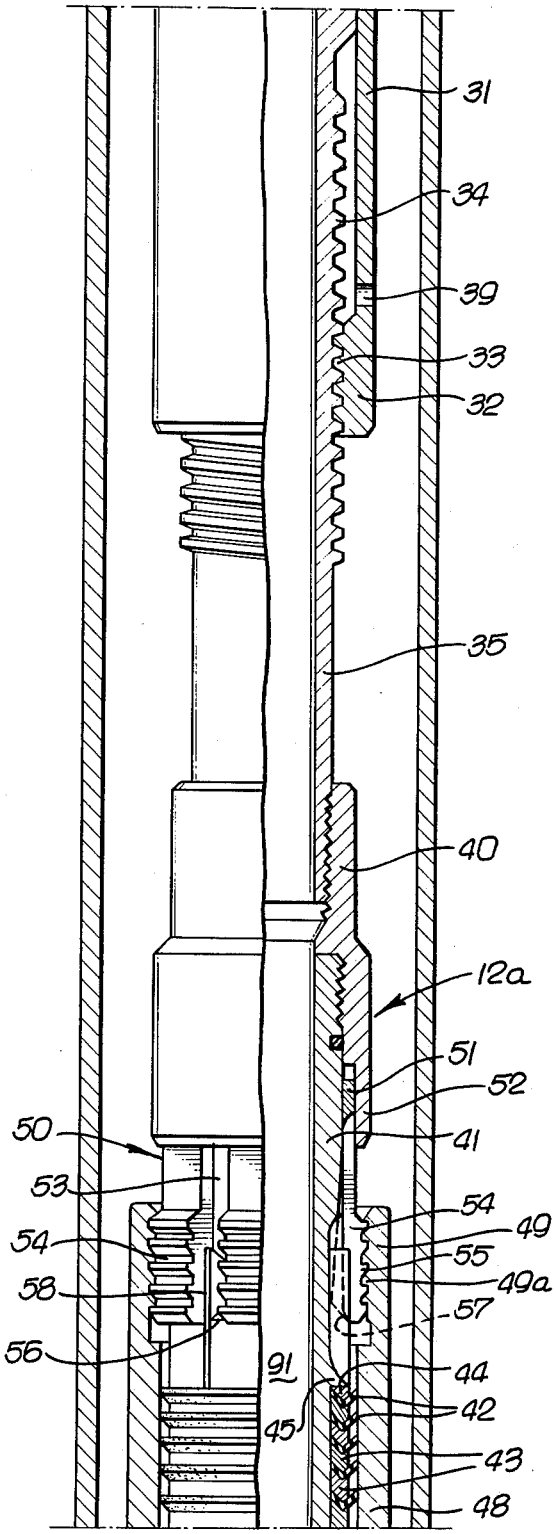
Figure 2D:
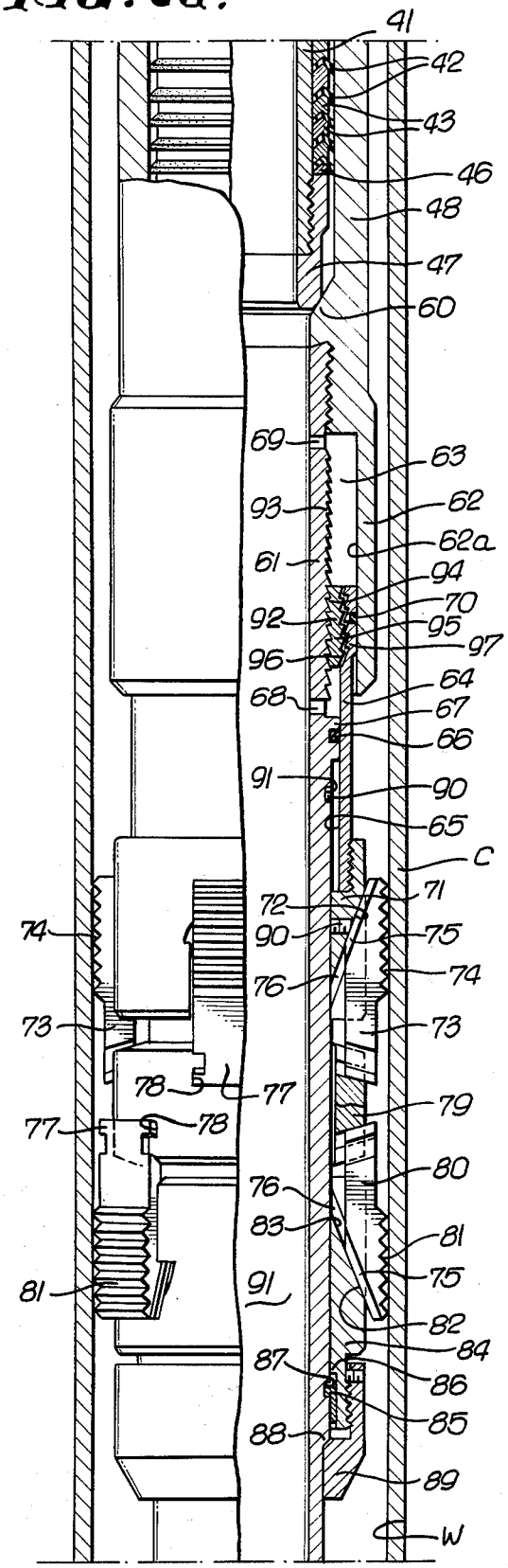
Figure 2E:
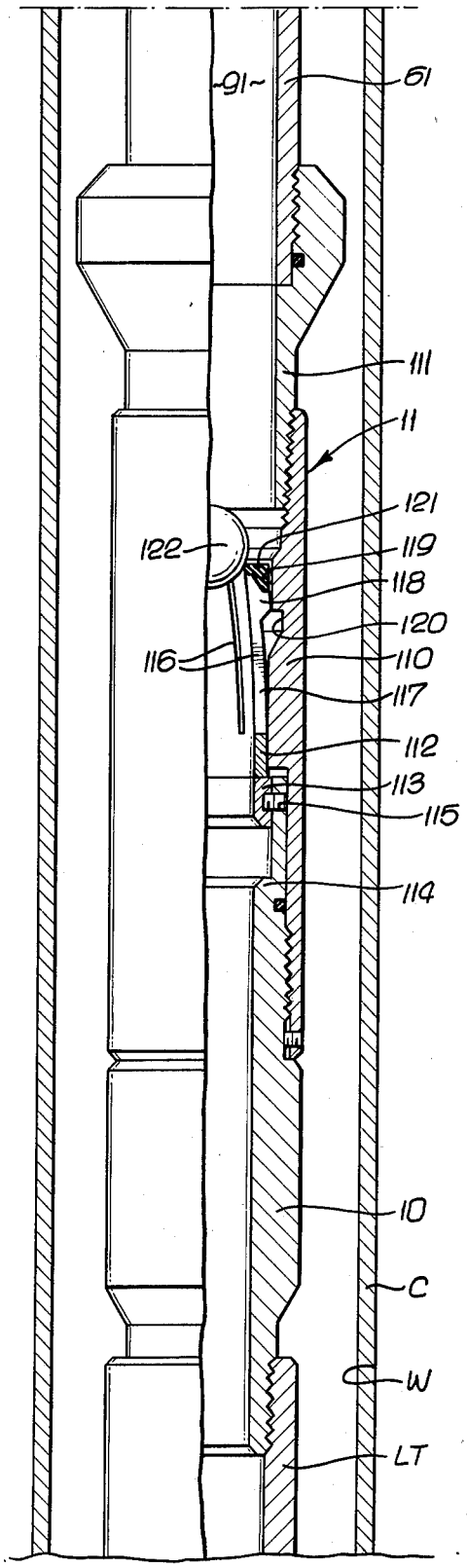

The lower end of the safety valve is connected to the rotational spacer 13, disclosed in FIGS. 2*b* and 2*c*. This spacer includes a top sub 30 threadedly secured to the lower end of the safety valve 14, the top sub, in turn being threadedly secured includes a top sub 30 threadedly secured to the lower end of the safety valve 14, the top sub, in turn, being threadedly secured to an elongate housing 31 having a lower head 32 provided with internal threads 33, which are preferably left hand, meshing with companion external threads 34 on a mandrel 35 extending upwardly with companion external threads 34 on a mandrel 35 extending upwardly within the housing and depending below the housing head 32. The mandrel has an upper head 36 carrying a seal ring 37 engaging the inner wall of the housing 31 to prevent fluid pressure from passing between the mandrel and housing. In this connection, a seal ring 38 is also provided on the top housing sub 30 that seals against the inner housing wall to prevent fluid leakage along the threaded connection between the sub and the upper portion of the housing. To prevent fluid from being trapped between the mandrel 35 and the housing 31, a suitable vent 39 is provided in the housing immediately above its threaded head 32.

The lower end of the mandrel 35 is secured to the top collar 40 of the seal assembly 12*a* which also includes a body 41 threadedly secured to the top collar 49 and carrying a plurality of seal members or rings 42 thereon, which are disclosed as being of the chevron type. The chevron seal members are spaced from one another by suitable separators 43, with a top adapter 44 engaging a downwardly facing shoulder 45 on the body and a lower adapter 46 engaging the upper end of a bottom sub 47 threadedly mounted on the body.

The seals are adapted to be received within a seal receptacle 48 constituting the upper portion of the tubing hanger 12, this receptacle having an upper left-hand threaded box 49 therein adapted to be threadedly engaged with a collet latch 50 surrounding the upper portion of the body 41. The collet has a limited degree of movement along the body, with its upper continuous sleeve portion 51 engaging the top collar or sub 40 and also being surrounded by a depending collar skirt 52. The collet has a plurality of slots 53 opening through its lower end to provide separate latch finger 54 having external left-hand threads adapted to mesh with the internal left-hand threads 49*a* on the hanger receptacle. The lower surfaces of the external threads are tapered to permit the collet latch to stab into the seal receptacle 48, with the threads 55 ratcheting along the internal threads 49*a*. An upward pull taken on the body 41 will shift a tapered holding surface 56 on the body up against a companion tapered surface 57 on the threaded fingers to hold them outwardly into full threaded engagement with the box threads 49*a*. When the threaded latch is to be released from the receptacle, the body 41 is rotated, which will cause drive keys 58 secured to the body to engage the trailing sides of the threaded fingers and rotate the entire latch 50 with respect to the box threads 49*a*. Since the threads are left-hand, the fingers will unthread in an upward direction as a result of right-hand rotation of the body 41 and collet 50.

The extent of insertion of the seal assembly 12*a* into the receptacle is limited by engagement of the bottom sub 47 with an inwardly directed shoulder 60 in the seal receptacle, which forms the upper portion of the tubing hanger 12. This tubing hanger includes a mandrel 61 threadedly secured to the seal receptacle 48, the latter having a depending cylinder 62 spaced from the mandrel to form an annular cylindrical space 63 therebetween. A piston 64 is slidably mounted in the cylinder, this piston having an internal surface 65 slidably and sealingly engaged by a suitable seal ring 66 mounted on a mandrel flange 67 below one or more ports 68 extending from the interior of the mandrel to its exterior. One or more additional ports 69 may be provided through the upper portion of the mandrel, opening into the cylindrical space 63 between the cylindrical skirt and the mandrel. The upper portion of the piston carries a suitable seal ring 70 adapted to slidably seal against the inner wall 62*a* of the cylinder 62. It is to be noted that the cylinder wall 62*a* has a greater internal diameter than the piston wall 65, which provides an end area over which fluid pressure in the mandrel and cylinder 63 can act in a downward direction, for the purpose described below.

The lower end of the piston 64 is threadedly secured to an upper expander 71 having downwardly and inwardly inclined surfaces 72 engaging companion surfaces on a set of arcuately spaced upper slips 73 having external wickers or teeth 74 adapted to engage and embed themselves in the wall of the well casing C. These slips have inclined side tongues 75 adapted to slide within companion grooves 76 in the expander, and they also have lower T-shaped heads 77 slidable radially within companion T-shaped grooves 78 in a slip ring 79, which also has T-shaped grooves 78 receiving slidable T-shaped heads 77 on a set of lower slips 80 that have external wickers or teeth 81 adapted to be embedded in the wall of the well casing C. These slips 80 are reversely arranged to the upper slips 73, and also have tapered surfaces 82 engaging companion tapered surfaces 83 on a lower expander 84, the expander surfaces tapering in an upper and inward direction. The slips 80 also have side tongues 75 engaging in companion grooves 76 in the expander 84. A shear ring 85 is mounted in the lower portion of the lower expander 84, engaging a downwardly facing shoulder 86 on the latter, the ring extending into a groove 87 in the mandrel 61. Downward movement of the mandrel relative to the lower expander is initially prevented by engagement of a downwardly facing shoulder 88 on the mandrel with a nut 89 threaded on the lower expander 84, whereas upward movement of the mandrel 61 relative to the lower expander is initially prevented by engagement of the lower side of the groove 87 with the shear ring 85.

The slips 73, 80 are disclosed in their expanded position in FIG. *2d*. Initially, they are retracted, with the piston 64 and upper expander 71 disposed in an upper position within the cylinder 62 and along the mandrel. When fluid under pressure is developed within the mandrel 61 it will shift the piston 64 downwardly, to move the upper expander 71 toward the lower expander 84 and thereby expand the slips 73, 80 outwardly into anchoring engagement with the wall of the well casing. Downward movement of the upper expander 71 within the upper slips 73 is at first prevented by means of a plurality of shear screws 90 (shown disrupted in FIG. *2d*) mounted in the upper expander and extending into an internal groove 91 in the mandrel 61, with the outer ends of the screws extending across the upper ends of the upper slips. At first, the piston 64, upper expander 71 and upper slips 73 move as a unit, to shift the slip ring 79 and lower slips 80 downwardly of the mandrel, moving the lower slips 80 downwardly and outwardly along the lower expander 84 into anchoring engagement with the wall of the well casing C. As the hydraulic pressure in the mandrel and cylinder increases to a further extent, the shear strength of the shear screws 90 is overcome and they are disrupted, the upper expander 71 then moving downwardly along the upper slips 73 to expand the latter outwardly into anchoring engagement with the well casing.

The piston 64 can shift downwardly along the mandrel 61 and cylinder skirt 62, as permitted by a one-way ratchet lock device 92, of a known type. As shown, the mandrel 61 has downwardly facing ratchet teeth 93 extending longitudinally along its exterior surface, which engage companion upwardly facing ratchet teeth 94 on a split sleeve 95 that has external cam teeth 96 engageable with companion cam teeth 97 on the piston. As the piston 64 moves downwardly, the split sleeve 95 can expand outwardly sufficiently to ratchet past the mandrel teeth 93. However, the piston cannot move upwardly along the mandrel, inasmuch as the coengaging cam teeth 97, 96 will urge the split sleeve inwardly and retain its ratchet teeth 94 fully meshed with the mandrel teeth 93. The specific ratchet arrangement illustrated is known per se and forms no part of the invention. It permits the lower expander 71 to be shifted downwardly along the mandrel 61 and the upper slips 73, but prevents upward movement of the piston and upper expander along the mandrel.

The lower end of the tubing hanger mandrel 61 is connected, directly or indirectly, to a device 11 that enables pressure to be built up in the tubing string UT, valve 14 and tubing hanger mandrel 61 for the purpose of setting the slips 73, 80 into anchoring engagement with the well casing, as described above. This device includes a pressure sub 110 threadedly attached to a sub 111 secured to the lower end of the mandrel 61. The pressure sub is also threadedly secured to the bottom sub 10, which is, in turn, threadedly attached to the upper end of the tubing string LT that extends downwardly through the well casing and into appropriate sealing relation to the lower packer WP which is anchored in packed-off condition in the well casing above the casing perforations P. Mounted within the top and bottom subs 110, 10 is an expandable valve seat 112, the lower end of which engages a ring 113 secured in an upper position spaced above a lower shoulder 114 in the bottom sub 10 by one or a plurality of shear screws 115. The seat has circumferentially spaced slots 116 extending upwardly through its open end, providing spring-like arms 117 that terminate in outwardly extending fingers 118 engaging the inner wall 119 of the top sub above an internal circumferential groove 120 in such sub. When so engaged the upper seal portions 121 of the fingers, which may be made of rubber or rubber-like material, will be engaged by a trip ball 122, dropped from the top of the well through the apparatus, which will prevent downward passage of fluid through the mandrel 61, thereby enabling pressure to be built up in the mandrel for the purpose of setting the slips 73, 80 into anchoring engagement with the well casing.

An increase in the fluid pressure within the mandrel 61 to a sufficient degree will shear the screws 115 and cause the seat 112 and ring 113 to move downwardly, limited by engagement of the ring with the upwardly facing shoulder 114 in the bottom sub 10, at which time the fingers 118 are disposed opposite the groove 120, inherently expanding outwardly into such groove. The expanded internal diameter through the fingers 118 and seat 112 is then greater than the diameter of the ball, the ball 122 then dropping downwardly through the seat and through the bottom sub 10, tubing LT, and packer WP into the bottom of the well bore, leaving the passage through the apparatus fully open.

In a typical use of the apparatus, the lower packer WP is run and set against the well casing above the perforations P, in a known manner. The lower tubing string LT, device 11, and tubing hanger 12 are then run in the casing on a work string (not shown), the lower tubing string being appropriately sealingly related to the well packer, whereupon the tripping ball 122 is dropped through the apparatus into engagement with the ball seat 112, which enables pressure to be built up in the tubing hanger mandrel 61 and the slips set in the position disclosed in the drawings. The work string is then removed, and the combination of the upper tubing string UT, shear out safety joint 15, tubing mounted safety valve 14, rotational spacer 113 in its extended position, and seal assembly **12*a* then run in the well casing, until the seal assembly enters the seal receptacle 48 of the tubing hanger and the lower adapter 47 engages the receptacle shoulder 60, the threaded latches 54 ratcheting past the box threads 49*a* and then expanding outwardly into full threaded engagement with the box or receptacle threads. When this occurs, the upper tubing hanger 16 will be disposed above its companion seat 17, whereupon the upper tubing string UT, shear out safety joint 15, tubing mounted safety valve 14, and rotational spacer 13 are rotated as a unit, with the surface control line 18 strapped or otherwise secured to the apparatus, to rotate the spacer housing 31 relative to the mandrel 35, which will result in the downward feeding of the housing 31 along the mandrel 35 and the movement of the upper tubing hanger 16 into appropriate engagement with its companion seat in the bushing 17. As noted above, such rotation will have no effect on the surface control line 18 since it moves as a unit with the safety valve 14, shear out joint 15, and the upper tubing string UT. During lowering of the upper tubing string UT, shear out safety joint 15, tubing mounted safety valve 14, and rotational spacer 13, pressure may be supplied to the fluid in the control line 18 to hold the valve in an open condition, such open condition being retained until the upper tubing hanger 16 engages its bushing seat 17.**

Due to unforeseen conditions at the well site, the upper tubing string UT may be pulled upwardly or elevated with sufficient force as to shear the screws 25 of the safety joint 15. This will result in elevation of the safety joint housing 21 completely from the mandrel 22, possibly disrupting the surface control line 18, which will relieve the pressure in the safety valve 14, which held it open, and cause it to close automatically.

I claim:

1. Well production apparatus comprising lower subsurface tubing hanger means adapted to be disposed in a well casing set within a well and to support lower tubing extending downwardly in the well casing from the lower hanger means, upper tubing hanger means disposed at the surface of the well, a well head seat at the surface of the well for said upper tubing hanger means, upper tubular means extending from said lower tubing hanger means to said upper hanger means, said upper tubular means including a spacer connected to said lower hanger means, safety valve means connected to the upper end of said spacer, and means including upper tubing connected to the upper end of said valve and to said upper tubing hanger means, control tubing connected to said safety valve for feeding fluid under pressure to said valve to actuate the same, said control tubing extending upwardly along said upper tubular means, means securing said control tubing to said upper tubular means, said spacer comprising upper and lower members and means interconnecting said members to change the effective length of said upper tubular means in responsive to movement of said upper tubular means, control tubing and upper member relative to said lower member to bring said upper tubing hanger means downwardly into engagement with said well head seat and with said upper tubular means engaged by said lower tubing hanger means.

2. Apparatus as defined in claim 1; said means interconnecting said members changing the effective length of said upper tubular means in response to rotation of said upper tubular means, control tubing and upper member relative to said lower member.

3. Apparatus as defined in claim 2; said means interconnecting said members being a threaded connection.

4. Apparatus as defined in claim 1; said upper tubular means further including connector means releasably secured to said lower hanger means to enable said upper tubular means to be released and separated from said lower hanger means for withdrawal from the well.

5. Apparatus as defined in claim 1; said upper tubular means further including a seal assembly releasably secured and sealingly related to said lower tubing hanger means to enable said upper tubular means to be released and separated from said lower hanger means for withdrawal from the well.

6. Apparatus as defined in claim 1; said upper tubular means further including a seal assembly, said assembly including a seal device shiftable into sealed relation to said lower hanger means and also including a latch adapted to be stabbed without rotation into said lower hanger means to secure said upper tubular means to said lower hanger means.

7. Apparatus as defined in claim 1; said upper tubular means further including a seal assembly, said assembly including a seal device shiftable into sealed relation to said lower hanger means and also including a threaded latch adapted to be stabbed without rotation into said lower hanger means and threadedly secured to said lower hanger means, whereby said upper tubular means is rotated to unthread said latch from said lower hanger means.

* * * * *